US008926268B2

(12) United States Patent
Fishler et al.

(10) Patent No.: US 8,926,268 B2
(45) Date of Patent: Jan. 6, 2015

(54) BLEED NOISE REDUCTION

(75) Inventors: Benjamin E. Fishler, San Diego, CA (US); Jay M. Francisco, Chula Vista, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 485 days.

(21) Appl. No.: 13/415,190

(22) Filed: Mar. 8, 2012

(65) Prior Publication Data

US 2013/0236288 A1 Sep. 12, 2013

(51) Int. Cl.
*F04D 29/66* (2006.01)
*F01D 25/04* (2006.01)

(52) U.S. Cl.
USPC ..... 415/119; 415/58.4; 415/58.6

(58) Field of Classification Search
CPC . F05B 2260/96; F04D 29/663; F04D 29/664; F04D 17/00; F04D 17/08; F04D 17/10; F04D 27/02; F04D 27/0207; F04D 27/0215; F04D 27/023
USPC ..... 415/119, 144, 52.1, 58.4, 58.6, 218.1, 415/219.1, 168.1, 169.1, 188, 1
See application file for complete search history.

(56) References Cited

U.S. PATENT DOCUMENTS

| | | | | |
|---|---|---|---|---|
| 3,821,999 | A * | 7/1974 | Guess et al. | 181/296 |
| 4,479,755 | A | 10/1984 | Skoe | |
| 2009/0191047 | A1 | 7/2009 | Schlinker et al. | |
| 2010/0104422 | A1* | 4/2010 | Martel et al. | 415/121.2 |
| 2010/0111688 | A1* | 5/2010 | Nolcheff et al. | 415/224 |
| 2010/0278632 | A1 | 11/2010 | Duong et al. | |
| 2010/0278633 | A1 | 11/2010 | Duong et al. | |
| 2011/0232288 | A1 | 9/2011 | Bizouard et al. | |

FOREIGN PATENT DOCUMENTS

| | | | |
|---|---|---|---|
| EP | 0092955 | A2 | 11/1983 |
| EP | 0059061 | B2 | 9/1992 |

* cited by examiner

*Primary Examiner* — Nathaniel Wiehe
*Assistant Examiner* — Michael Sehn
(74) *Attorney, Agent, or Firm* — Kinney & Lange, P.A.

(57) ABSTRACT

An assembly for reducing compressor noise includes a compressor and an acoustic shield. The compressor has a rotor with a plurality of blades mounted thereto. Additionally, the compressor has one or more bleed slots therein. The acoustic shield is disposed adjacent to the one more bleed slots and spaced at a distance therefrom.

19 Claims, 2 Drawing Sheets

BLEED NOISE REDUCTION

BACKGROUND

This invention relates generally to the reduction of compressor noise. One possible application of the system is for gas turbine engines, and in particular, auxiliary power units.

To increase engine operational ranges and to prevent engine surge, gas turbine engines utilize bleed holes/slots, which bleed air off the engine gas flow path. Gas turbine engine compressors rotate at high speeds, and in some designs the gas flow becomes supersonic relative to some portion of the impeller blade. One result of this rotation is a series of shock waves generated at the blade passing frequency (BPF), where the BPF is a "pure tone" frequency at which compressor blades pass a given fixed point in space, which exceeds the broadband noise portion of the acoustic spectrum. As pressure waves propagate from the near field at the compressor blade tip into the far field inside the inlet duct, they degenerate into a multi-tone sound spectrum characterized as "buzz saw" noise.

In addition to buzz saw noise generation, instances of supersonic flow in the region of the compressor blade tip causes pressure spikes to occur due to pressure perturbations/discontinuities across the pressure and suction sides of the compressor blades. This phenomenon results in the generation of pressure waves at a harmonic of the BPF frequency. These pressure waves can interact with and exit through the bleed holes/slots and result in the generation of significant amounts of sound power being generated by the compressor.

SUMMARY

An assembly for reducing compressor noise includes a compressor and an acoustic shield. The compressor has a rotor with a plurality of blades mounted thereto. Additionally, the compressor has one or more bleed slots therein. The acoustic shield is disposed adjacent to the one more bleed slots and spaced at a distance therefrom.

A centrifugal compressor includes a rotor, a plurality of blades, a shroud, and an acoustic shield. The plurality of blades are mounted to the rotor and the rotor is capable of rotating the blades at a blade passing frequency. The shroud is disposed around the rotor and the plurality of blades and has one or more bleed slots therein. The acoustic shield is disposed adjacent to the one more bleed slots and is spaced at a distance therefrom.

In another aspect, a method for reducing compressor noise that includes providing the compressor with one or more bleed slots therein, fabricating an acoustic shield with a concave shaped wall, and disposing the acoustic shield adjacent the one more bleed slots such that the concave shaped wall interfaces with and is disposed at a distance from the one or more bleed slots.

DETAILED DESCRIPTION

Figure 1:
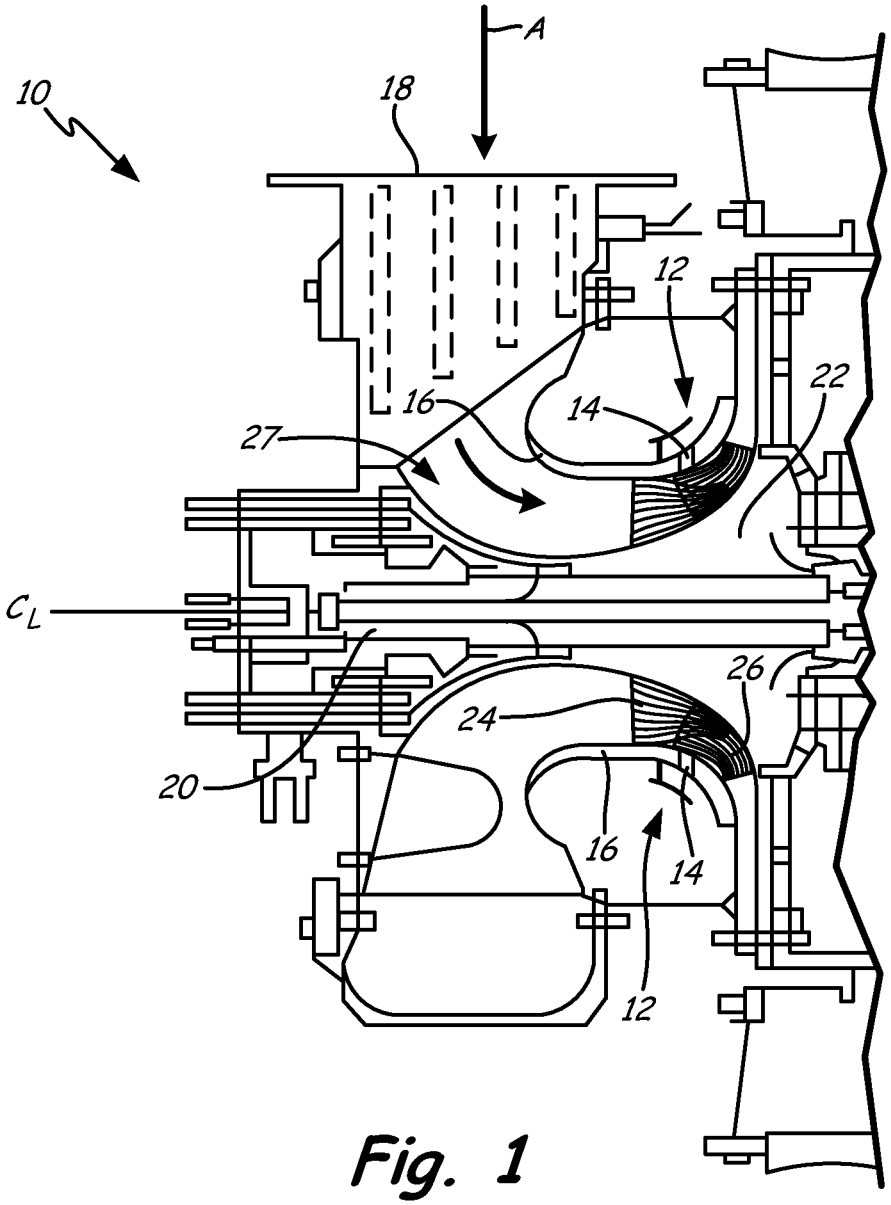
FIG. 1 is a cross-sectional side view of a first embodiment of a centrifugal compressor with an acoustic shield disposed adjacent bleed slots.
Figure 1A:
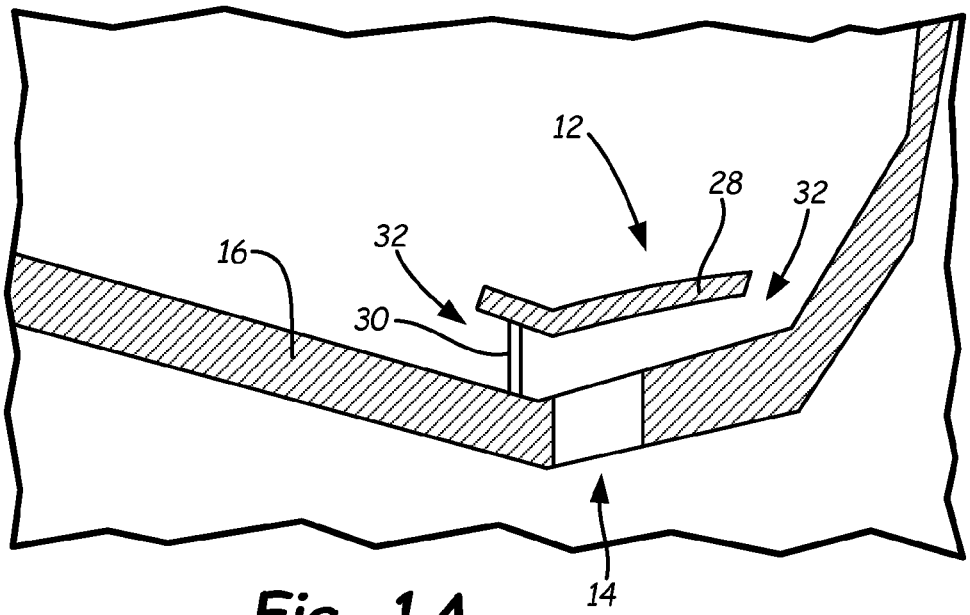
FIG. 1A is an enlarged cross-sectional side view of the acoustic shield and the bleed slot of FIG. 1.

FIG. 1 is a cross-sectional side view of a first embodiment of a centrifugal compressor 10 including an acoustic shield 12 disposed adjacent to bleed slots 14. FIG. 1A shows an enlarged cross-sectional side view of acoustic shield 12 and bleed slot 14. FIG. 1 shows compressor 10, which includes a shroud 16, an inlet 18, a shaft 20, an impeller 22, main blades 24, and splitter blades 26. FIG. 1A shows features of acoustic shield 12, which includes a wall 28, struts 30, and forward and aft openings 32.

The operation and construction of centrifugal compressor 10 is known in the art and is discussed, for example, in U.S. Patent Application Publication Nos. 2009/0191047A1 and 2010/0278632, which are incorporated herein by reference. Centrifugal compressors can be used as part of gas turbine engines and auxiliary power units to compress air for the combustor, and in some configurations, to provide pressurized air for an environmental control system and/or various additional pneumatic accessories.

Compressor 10 is arranged around centerline axis $C_L$. Acoustic shield 12 is disposed radially outward of stator portions of compressor 10 adjacent and radially outward of bleed slots 14. Bleed slots 14 extend through annular stator compressor shroud 16 downstream of inlet 18. Shaft 20 extends along centerline axis $C_L$ and is mounted to rotor impeller 22. Main blade 24 and splitter blade 26 are mounted to impeller 22. Together shaft 20 and impeller 22 rotate main blades 24 and splitter blades 26 within shroud 16 in flow path 27.

The embodiment shown in FIGS. 1 and 1A, utilizes splitter blades 26 alternately arranged with main blades 24. In other embodiments compressor 10 can utilize multiple numbers of splitter blades 26 positioned relative to main blades 24. Splitter blades 26 have a different geometry (shape, beta angle, or size), such as a shorter chord length, than that of main blades 24. Splitter blades 26 and main blades 24 each have a fixed edge attached to impeller 22 and a free edge unattached and disposed adjacent shroud 16 and bleed slots 14.

In the embodiment shown in FIGS. 1 and 1A, bleed slots 14 extend through shroud 16 and are positioned adjacent to the tips of splitter blades 26 aft of main blades 24. Bleed slots 14 can have different geometries, for example, a continuous slot or distinct holes. The position of bleed slots 14 will vary from embodiment to embodiment. In one embodiment, bleed slots 14 communicate with a bleed manifold (not shown) which delivers compressed air from compressor 10 to a variety of systems such as an air starter motor for a main engine, an anti-icing system, a cargo hold heating system, a smoke detection system, a potable water pressurization system, a cabin air/environmental control system, and pneumatically pressurized components of the hydraulic system. Even if not used for auxiliary purposes, bleed air can be bled off of the compressor to increase the operating range of the compressor and to decrease compressor surge.

Air A enters compressor 10 at inlet 18 and continues along flow path 27 between shroud 16 and impeller 22. The geometry of shroud 16, impeller 22, main blades 24, and splitter blades 26 acts to compress air flowing along flow path 27.

As impeller 22 rotates, air passing through flow path 27 travels supersonic relative to main blade 24 and splitter blade 26. This results in a series of pressure shock waves, which are generated at the blade passing frequency (BPF) and multiples thereof. As the pressure waves propagate away from main blades 24 and splitter blades 26, these waves can interact with and exit through bleed slots 14 and result in the generation of a significant amount of the sound power being generated by compressor 10.

Therefore, compressor 10 is configured with acoustic shield 12 to enhance noise reduction by reflecting and/or absorbing acoustic pressure waves at BPF, and multiples of BPF such as twice, three, four, or more times BPF and other frequencies. This reduces noise intensity in a desired range such as at twice BPF and in a range spanning around twice BPF while not reducing the operational performance of compressor 10. Additionally, embodiments employing acoustic material such as a honeycomb liner or acoustic-treated surface that is tuned for around twice BPF or multiples thereof can be used to absorb acoustic energy and reduce noise intensity. Acoustic shield 12 significantly reduces the sound power from bleed slots 14, thereby reducing the overall sound power levels exiting the inlet of compressor 10, consequently reducing the sound pressure levels at a distance from compressor 10.

FIG. 1A shows a first embodiment of acoustic shield 12. In this embodiment, wall 28 is a solid surface and is spaced above (radially outward from) bleed slots 14 and shroud 16 at a distance by struts 30. Acoustic shield 12 has forward and aft openings 32 at opposite ends.

The distance wall 28 is spaced from shroud 16 should be selected so as not to be too great so desired noise suppression is not achieved nor too small so as to substantially reduce or choke flow through bleed slots 14 and degrade compressor 10 performance. The distance will vary from embodiment to embodiment. In one embodiment, this distance is between about ⅛ a wavelength of twice BPF and about ½ a wavelength of twice BPF, which allows acoustic shield 12 to reflect, absorb, and/or divert pressure waves emanating from bleed slots 14.

In the embodiment shown in FIG. 1A, wall 28 comprises a band-like structure that goes circumferentially around the entire shroud 16 at the axial location of bleed slots 14. The axial width of wall 28 will vary from embodiment to embodiment. In one embodiment, the axial width of wall 28 is about three times the axial width (diameter of a bleed hole) of bleed slots 14. Although illustrated as disposed symmetrically above bleed slots 14, wall 28 is not symmetric in all embodiments. Wall 28 is supported at various locations by aerodynamic struts 30. Struts 30 extend from wall 28 to shroud 16.

Figure 2:
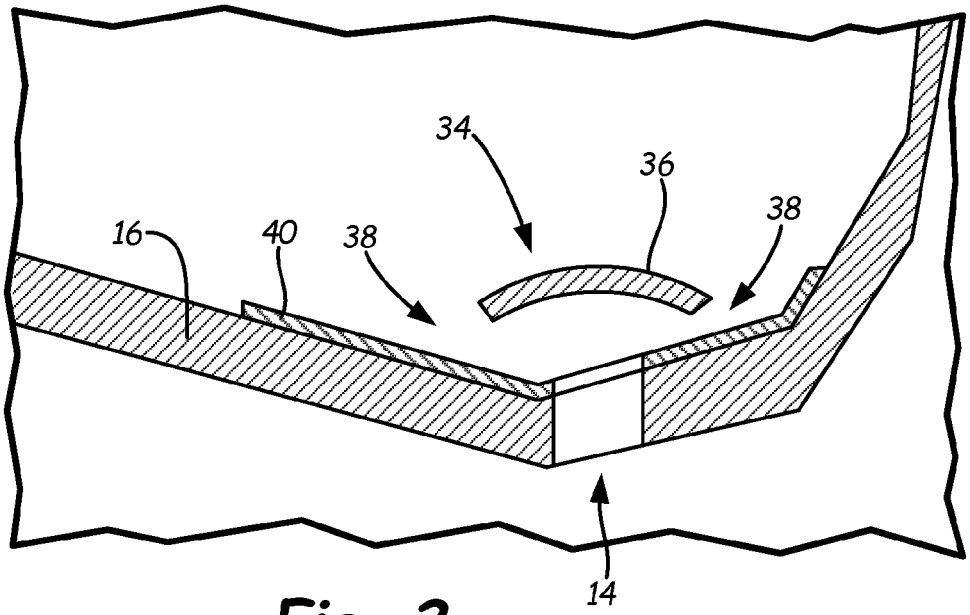
FIG. 2 is a cross-sectional view of a second embodiment of the acoustic shield.

FIG. 2 shows a second embodiment of acoustic shield 34. Acoustic shield 34 includes concave wall 36, forward and aft openings 38, and liner 40. Similar to the embodiment of FIGS. 1 and 1A, concave wall 36 is supported on struts (not shown).

In the embodiment shown in FIG. 2, concave wall 36 is comprised of a honeycomb-like liner or similar acoustic-treated surface that is tuned for (or as close to) specific frequencies such as twice BPF. Concave wall 36 is curved with respect to bleed slot centerline and bleed slots 14 to maximize absorption area and to reflect and resonate the acoustic waves between concave wall 36 and acoustic liner 40 (disposed below concave wall 36 along surface of shroud 16) adjacent bleed slots 14. This resonating effect eventually leads to dissipation of the acoustic pressure waves.

Concave wall 36 can extend circumferentially around the entire shroud 16 with disposition of bleed slots 14 and extends axially forward and aft of bleed slots 14. The axial width of concave wall 36 will vary from embodiment to embodiment. In the embodiment shown in FIG. 2, axial width of concave wall 36 is about three times an axial width (diameter if a bleed hole) of bleed slots 14. Although illustrated as disposed symmetrically above (i.e., radially and axially relative too) bleed slots 14, concave wall 36 is not symmetric in all embodiments.

The distance that concave wall 36 is spaced from shroud 16 and bleed slots 14 should be selected so as not to be too great so desired noise suppression is not achieved nor to small so as to excessively impede flow through bleed slots 14 and degrade compressor 10 performance. The distance will vary from embodiment to embodiment. In one embodiment, this distance is between about ⅛ a wavelength of twice BPF and about ½ a wavelength of twice BPF, which allows acoustic shield 34 to reflect, absorb, and/or divert pressure waves emanating from bleed slots 14.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly for reducing compressor noise, comprising:

a compressor including a rotor with a plurality of blades mounted thereto, the compressor including one or more bleed slots therein; and an acoustic shield disposed adjacent the one more bleed slots and spaced at a distance therefrom, wherein the acoustic shield is disposed symmetrically with respect to a centerline of the one or more bleed slots.

2. The assembly of claim 1, wherein the compressor comprises a centrifugal compressor with the plurality of blades including main blades and splitter blades.

3. The assembly of claim 2, wherein the one or more bleed slots extend through a shroud of the compressor and extend adjacent to the plurality of blades.

4. The assembly of claim 3, wherein an outer surface of the shroud adjacent an exit opening of the one or more bleed slots has an acoustic liner mounted thereto.

5. The assembly of claim 1, wherein the acoustic shield comprises a honeycomb-like acoustic liner with a wall having a concave shape, and wherein the wall is disposed to interface with the one or more bleed slots.

6. The assembly of claim 1, wherein the acoustic shield is configured to reflect and dissipate acoustic pressure waves generated at a frequency of about a multiple of a blade passing frequency of the plurality of blades to reduce noise intensity.

7. The assembly of claim 1, wherein the distance the acoustic shield is disposed from the one or more bleed slots is between about ⅛ a wavelength of twice a blade passing frequency of the plurality of blades and about ½ a wavelength of twice a blade passing frequency of the plurality of blades.

8. The assembly of claim 1, wherein a wall of the acoustic shield has an axial width about three times greater than an axial width of the one or more bleed slots, and wherein the acoustic shield has openings at forward and aft ends thereof.

9. The assembly of claim 1, wherein the one or more bleed slots comprise a plurality of bleed holes.

10. The assembly of claim 1, wherein the compressor comprises a portion of an auxiliary power unit.

11. A centrifugal compressor comprising:

a rotor;

a plurality of blades mounted to the rotor, the rotor configured to rotate the blades at a blade passing frequency;

a shroud disposed around the rotor and the plurality of blades, the shroud including one or more bleed slots therein; and an acoustic shield disposed adjacent the one more bleed slots and spaced at a distance therefrom, wherein the acoustic shield is disposed symmetrically with respect to a centerline of the one or more bleed slots.

12. The compressor of claim 11, wherein an outer surface of the shroud adjacent an exit opening of the one or more bleed slots has an acoustic liner mounted thereto.

13. The compressor of claim 11, wherein the acoustic shield comprises a honeycomb-like acoustic liner with a wall having a concave shape, and wherein the wall is disposed to interface with the one or more bleed slots.

14. The compressor of claim 11, wherein the acoustic shield is configured to reflect and dissipate acoustic pressure waves generated at a frequency of about a multiple of the blade passing frequency of the plurality of blades to reduce noise intensity.

15. The compressor of claim 11, wherein the distance the acoustic shield is disposed from the one or more bleed slots is between about ⅛ a wavelength of twice the blade passing frequency of the plurality of blades and about ½ a wavelength of twice the blade passing frequency of the plurality of blades.

16. A method for tuning a compressor, the method comprising:

fabricating an acoustic shield with a concave shaped wall; and disposing the acoustic shield adjacent one or more bleed slots of a compressor such that the concave shaped wall interfaces with and is disposed at a distance from the one or more bleed slots, wherein the acoustic shield is disposed symmetrically with respect to a centerline of the one or more bleed slots.

17. The method of claim 16, wherein the step of disposing the acoustic shield adjacent the one or more bleed slots includes placing the wall between about ⅛ a wavelength of twice a blade passing frequency of the plurality of blades and about ½ a wavelength of twice a blade passing frequency of the plurality of blades from the one or more bleed slots.

18. The method of claim 16, further comprising designing the acoustic shield to reflect and dissipate acoustic pressure waves generated at a frequency of about a multiple of the blade passing frequency of the plurality of blades to reduce noise intensity.

19. The method of claim 16, further comprising mounting an acoustic liner to an outer surface of a shroud of the compressor adjacent the one or more bleed slots.

* * * * *